US007255304B2

(12) United States Patent
Ericson et al.

(10) Patent No.: US 7,255,304 B2
(45) Date of Patent: Aug. 14, 2007

(54) TANDEM MOTOR ACTUATOR

(75) Inventors: Charles R. Ericson, Corvallis, MT (US); Michael C. May, Healdsburg, CA (US)

(73) Assignee: General Dynamics Ordnance and Tactical Systems, Inc., St. Petersburg, FL (US)

( * ) Notice: Subject to any disclaimer, the term of this patent is extended or adjusted under 35 U.S.C. 154(b) by 428 days.

(21) Appl. No.: 11/005,368

(22) Filed: Dec. 6, 2004

(65) Prior Publication Data

US 2005/0150999 A1 Jul. 14, 2005

Related U.S. Application Data

(60) Provisional application No. 60/527,562, filed on Dec. 8, 2003.

(51) Int. Cl.
*F42B 10/64* (2006.01)

(52) U.S. Cl. ..... 244/3.24; 244/3.28

(58) Field of Classification Search ..... 244/3.24, 244/3.28, 3.29
See application file for complete search history.

(56) References Cited

U.S. PATENT DOCUMENTS 4,163,534 A 8/1979 Seeger
4,296,895 A 10/1981 Pazmany
4,523,728 A 6/1985 Frazer
4,565,340 A 1/1986 Bains
4,892,253 A 1/1990 Speicher et al.
5,031,856 A * 7/1991 Steuer et al. ..... 244/3.27
5,379,968 A 1/1995 Grosso
5,425,514 A 6/1995 Grosso
5,452,864 A 9/1995 Alford
5,505,408 A 4/1996 Speicher et al.
5,630,564 A 5/1997 Speicher et al.
5,647,558 A 7/1997 Linick
5,662,290 A 9/1997 Voigt
5,788,178 A 8/1998 Barrett et al.
5,887,821 A 3/1999 Voigt et al.
5,950,963 A 9/1999 Speicher et al.
6,073,880 A * 6/2000 Voigt et al. ..... 244/3.28
6,135,387 A 10/2000 Seidel et al.
6,186,443 B1 2/2001 Shaffer
6,224,013 B1 5/2001 Chisolm
6,247,666 B1 * 6/2001 Baker et al. ..... 244/3.21
6,315,239 B1 11/2001 Voigt (Continued)

FOREIGN PATENT DOCUMENTS

WO WO 2005/026654 A2 3/2005

*Primary Examiner*—Timothy D. Collins
(74) *Attorney, Agent, or Firm*—Hunton & Williams

(57) ABSTRACT

The invention relates to an actuator system for a projectile having a first and second pair of opposing steering fins disposed in a transverse plane of the projectile. The first pair of opposing steering fins includes a first fin and second fin. The second pair of opposing steering fins includes a third fin and a fourth fin. The actuator system comprises a first motor assembly configured to control the position of the first pair of opposing steering fins, and a second motor assembly configured to control the position of the second pair of opposing steering fins. The first motor assembly and second motor assembly are mounted axially along an axis of the projectile such that a first portion of the first motor assembly is telescopically received within a second portion of the second motor assembly.

20 Claims, 8 Drawing Sheets

U.S. PATENT DOCUMENTS 6,446,906 B1 9/2002 Voigt et al.
6,460,446 B1 10/2002 Kathe
6,474,593 B1 11/2002 Lipeles et al.
6,581,871 B2 6/2003 Pijaca et al.
6,727,485 B2 4/2004 Rastegar et al.
6,752,352 B1 6/2004 May et al.
6,880,780 B1 4/2005 Perry et al.
6,923,123 B2 8/2005 Rastegar et al.
6,935,242 B2 8/2005 Rastegar et al.
6,981,672 B2 1/2006 Clancy et al.
7,090,163 B2 8/2006 Rastegar et al.
2005/0150999 A1 7/2005 Ericson et al.

* cited by examiner

TANDEM MOTOR ACTUATOR

This application claims priority to U.S. Provisional Application No. 60/527,562 filed Dec. 8, 2003, the contents of which are incorporated herein by reference in their entirety.

BACKGROUND OF THE INVENTION

The present invention generally relates to steering fin control systems for missiles and other projectiles and, more particularly, to the actuator systems within these vehicles which are coupled to the steering fins to impart steering forces to the vehicle during flight.

Various types of steering control systems are known. Such systems include those described in U.S. Pat. Nos. 5,887,821, 5,505,408, 4,163,534. Such systems further include those described in U.S. Pat. No. 6,752,352 and U.S. patent application Ser. No. 10/390,423, both of which are assigned to the Assignee of the present application and incorporated herein by reference in their entirety. However, there is a need for a steering control system that is compact, lightweight, makes efficient use of the interior space of a projectile, and provides steering control over a plurality of steering fins in a more efficient manner.

Accordingly, the present invention provides an actuator system for controlling the positioning of the plurality of steering fins of a projectile that overcomes the disadvantages of known systems while offering features not present in known systems. Although certain deficiencies in the related art are described in this background discussion and elsewhere, it will be understood that these deficiencies were not necessarily heretofore recognized or known as deficiencies. Furthermore, it will be understood that, to the extent that one or more of the deficiencies described herein may be found in an embodiment of the claimed invention, the presence of such deficiencies does not detract from the novelty or nonobviousness of the invention or remove the embodiment from the scope of the claimed invention.

SUMMARY OF THE INVENTION

The invention, according to one embodiment, relates to an actuator system for a projectile having a first and second pair of opposing steering fins disposed in a transverse plane of the projectile. The first pair of opposing steering fins includes a first fin and second fin. The second pair of opposing steering fins includes a third fin and a fourth fin. The actuator system comprises a first motor assembly configured to control the position of the first pair of opposing steering fins, and a second motor assembly configured to control the position of the second pair of opposing steering fins. The first motor assembly and second motor assembly are mounted axially along an axis of the projectile such that a first portion of the first motor assembly is telescopically received within a second portion of the second motor assembly.

The invention, according to another embodiment, relates to an actuator system for a projectile having a plurality of steering fins disposed in a first transverse plane of the projectile, the plurality of steering fins including a first fin opposing a second fin, and a third fin opposing a fourth fin, the actuator system for controlling the positioning of the plurality of steering fins. The system comprises a first motor assembly adapted to apply torque to a first output shaft coupled to the first fin and a second output shaft coupled to the second fin such that the first output shaft and the second output shaft rotate in a first rotational direction, a second motor assembly adapted to apply torque to a third output shaft coupled to the third fin and a fourth output shaft coupled to the fourth fin such that the third output shaft and the fourth output shaft rotate in a second rotational direction. The first motor assembly and second motor assembly are mounted axially along an axis of the projectile such that a first portion of the first motor assembly is telescopically received within a second portion of the second motor assembly.

BRIEF DESCRIPTION OF THE DRAWINGS

The present invention can be more fully understood by reading the following detailed description of the presently preferred embodiments together with the accompanying drawings, in which like reference indicators are used to designate like elements, and in which.

DETAILED DESCRIPTION OF PREFERRED EMBODIMENTS

Various embodiments of actuator systems for controlling the positioning of a plurality of steering fins on a projectile are hereinafter described.

Figure 1:
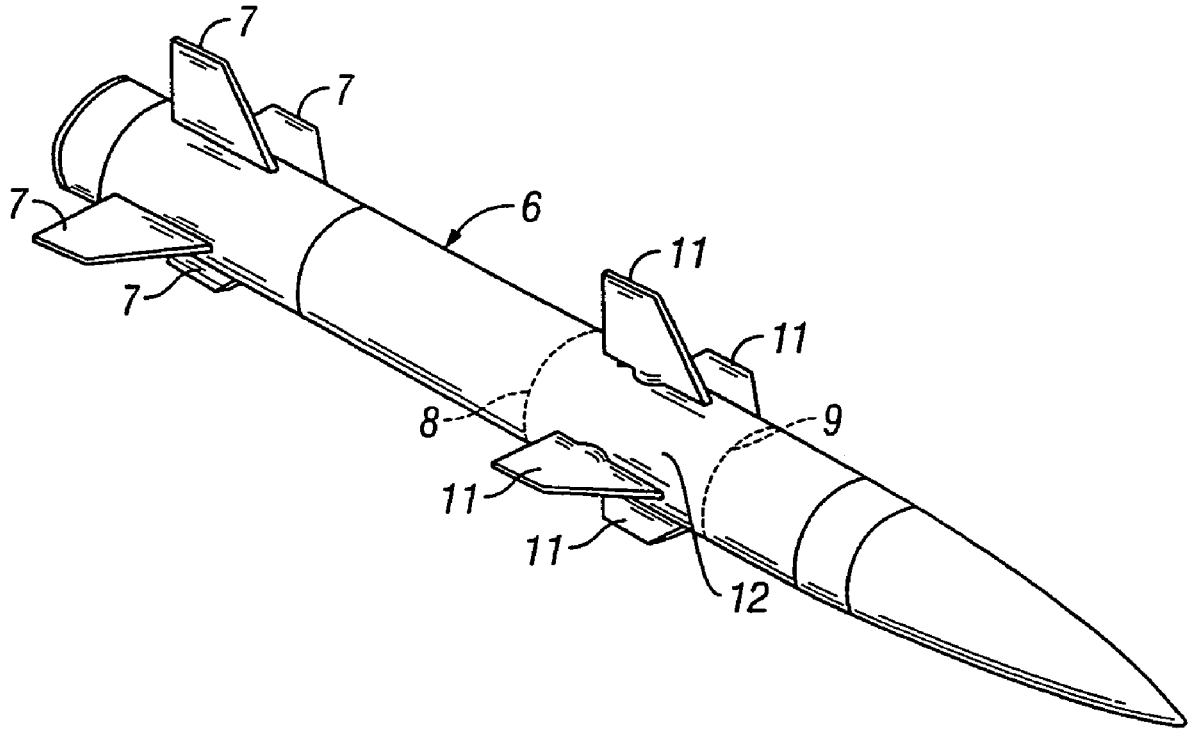
FIG. 1 is a perspective view of an illustrative projectile including an actuator system in accordance with one embodiment of the invention.

FIG. 1 is a perspective view of an illustrative projectile in accordance with one embodiment of the invention. As shown in FIG. 1, projectile 6 includes a plurality of tail fins 7, and a plurality of forward canard or steering fins 11. The steering fins 11 may be pivoted by controlling output shafts (not shown in FIG. 1), which are coupled to the fins 11, and that extend into the body 12 of the projectile 6. The pivoting motion of steering fins 11 while the projectile 6 is in flight allows an operator to control the trajectory of the projectile 6 by imparting the necessary forces to reorient the projectile 6, to develop yaw or pitch of the vehicle, and effectively steer the projectile 6. In this embodiment, control over the positioning of the steering fins 11 is imparted by an actuator system (not illustrated in FIG. 1) disposed within body 12 of the projectile 6 approximately within the region between broken lines 8 and 9. While projectile 6 is shown in the form of a missile, it should be appreciated that in alternate embodiments projectile 6 may be any fin-guided vehicle.

Figure 1A:
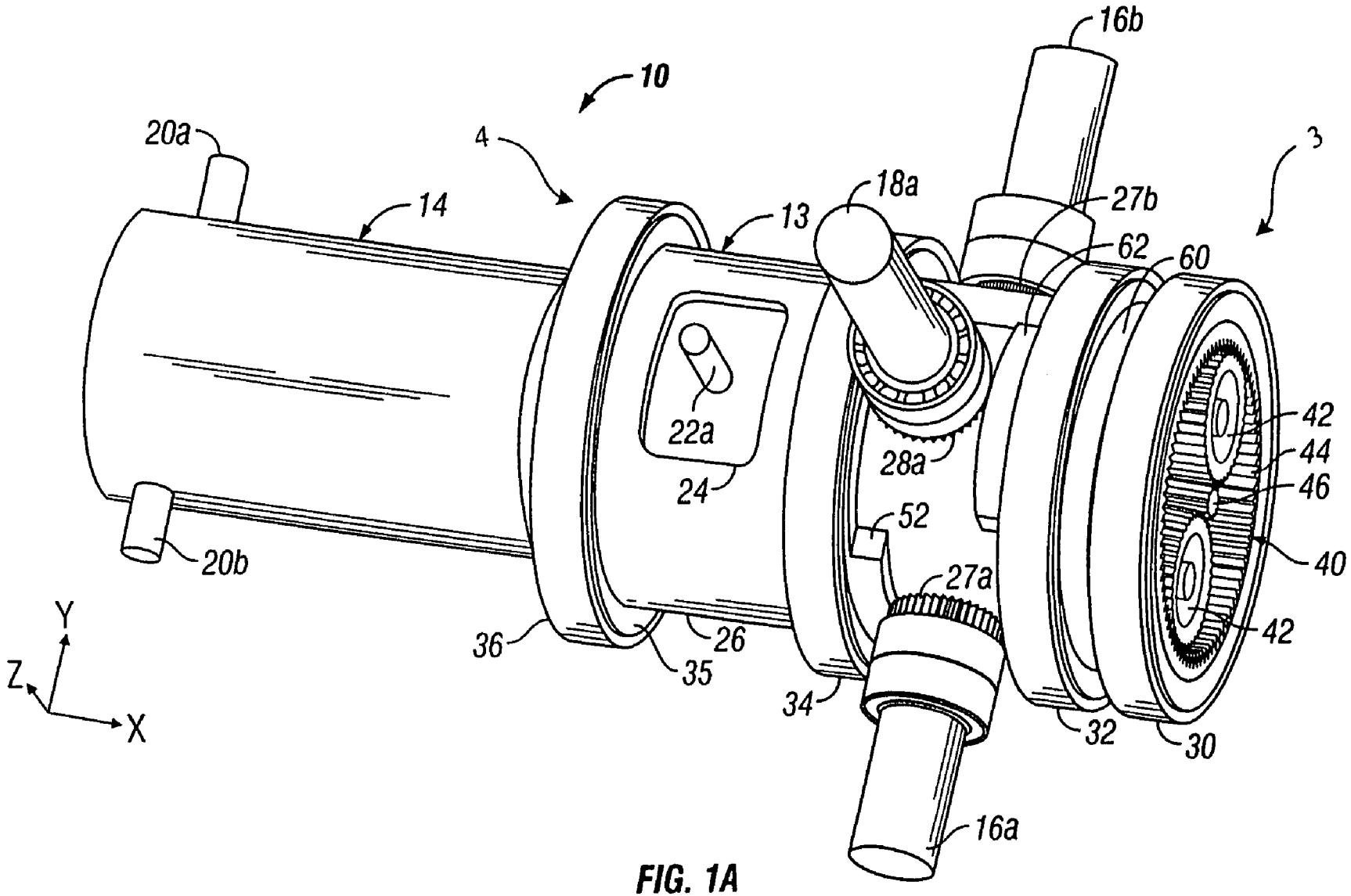
FIG. 1A is a perspective view of an illustrative actuator system in accordance with an embodiment of the invention.
Figure 2:
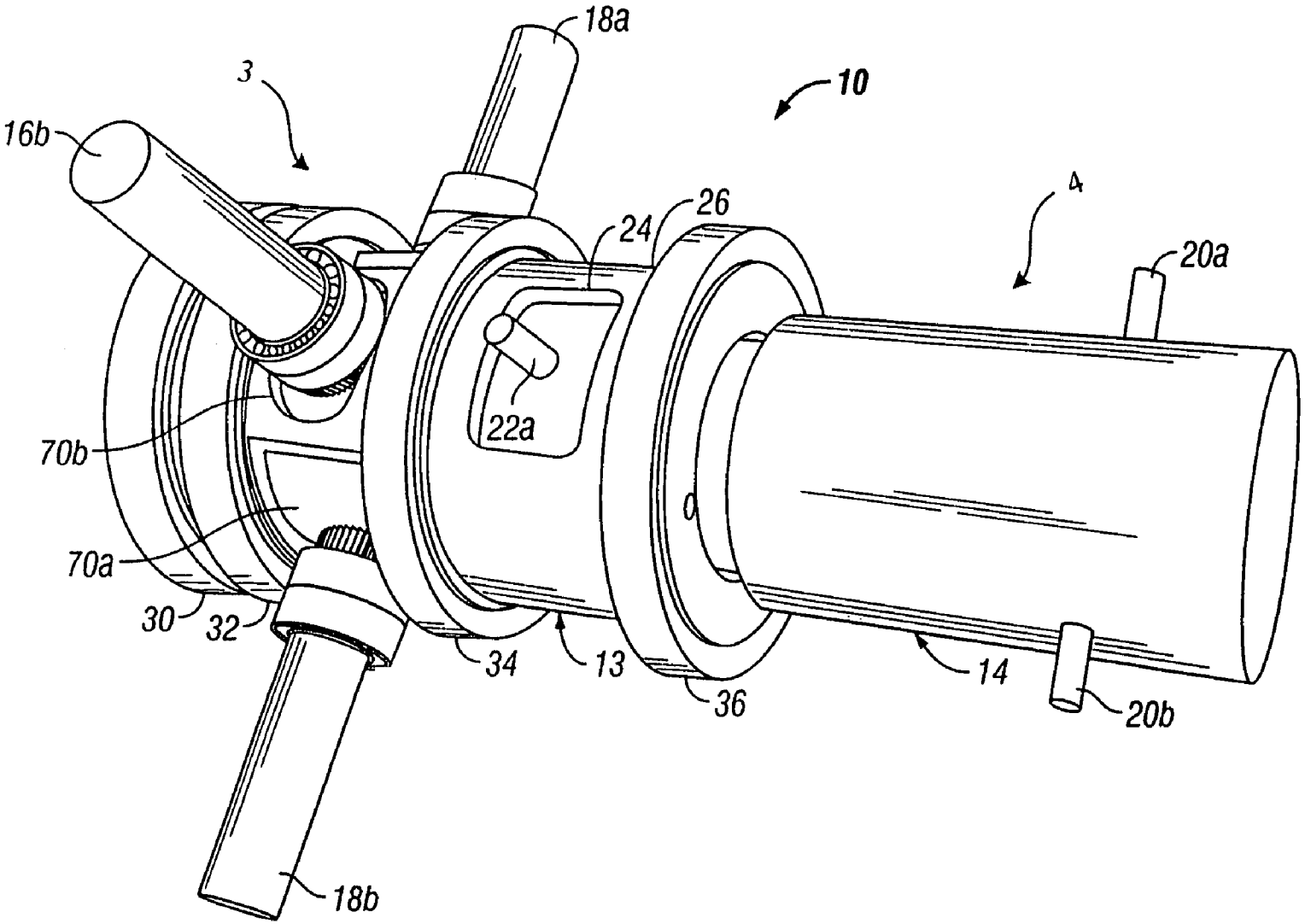
FIG. 2 is a rear perspective view of the actuator system of FIG. 1A in accordance with an embodiment of the invention.
Figure 3:
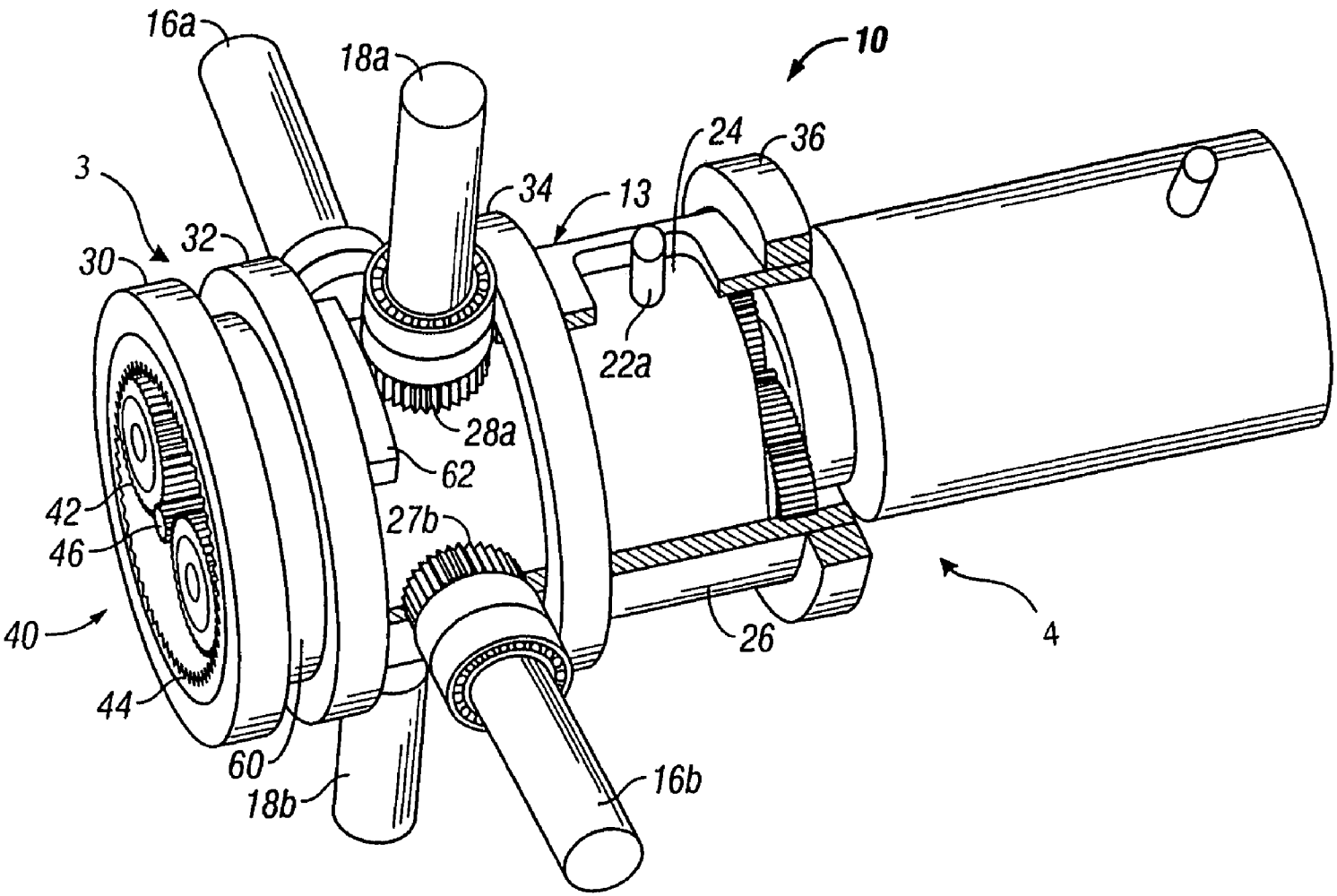
FIG. 3 is a partial sectional, perspective view of the actuator system of FIG. 1A in accordance with an embodiment of the invention.
Figure 4:
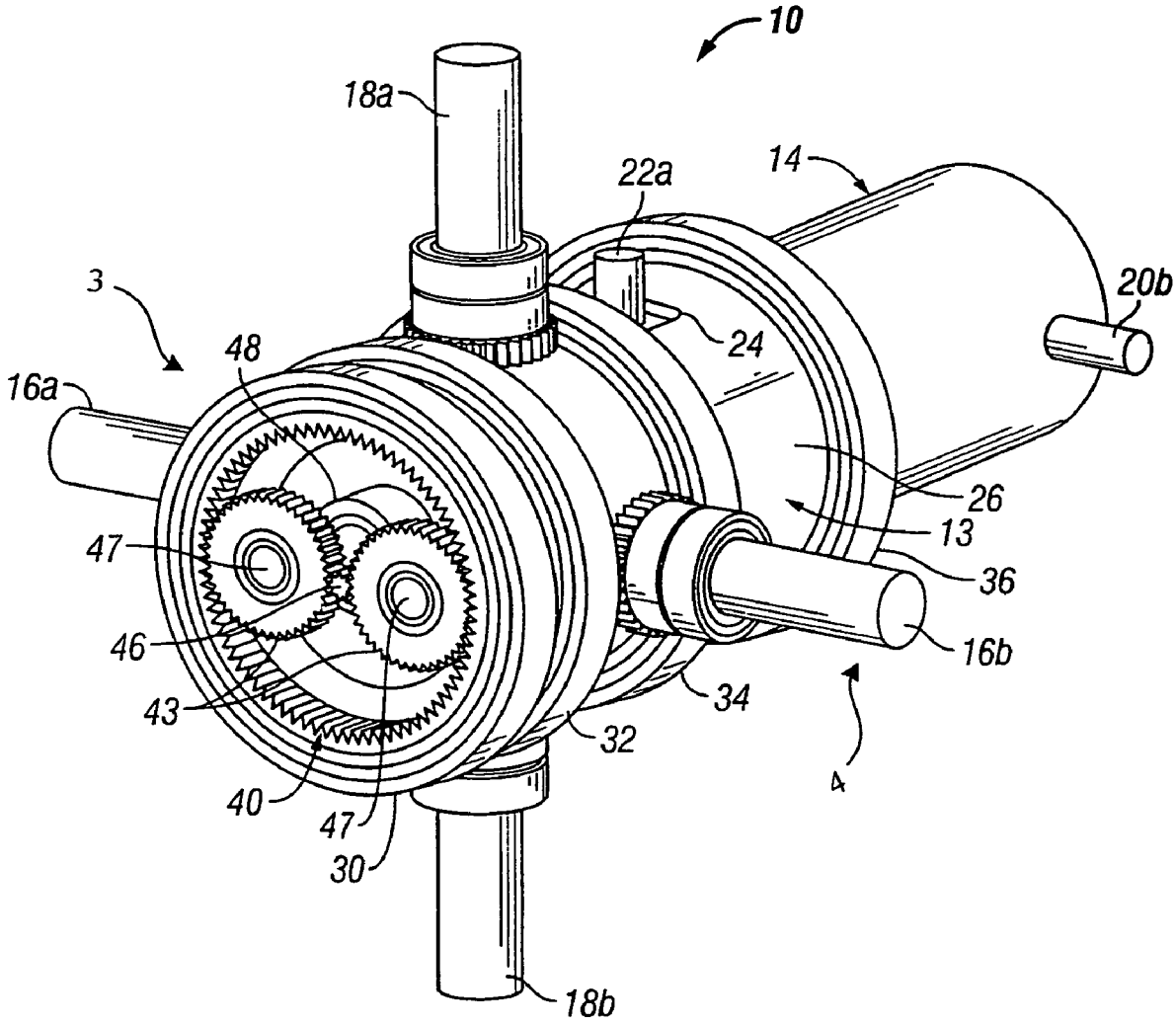
FIG. 4 is a perspective view of the actuator system of FIG. 1A in accordance with an embodiment of the invention.

FIG. 1A is a perspective view of an illustrative actuator system in accordance with one embodiment of the invention. FIGS. 2, 3 and 4 provide various perspective views of the actuator system of FIG. 1A in further detail. As shown in FIG. 1A, actuator system 10 includes a forward motor assembly 3 and a rear motor assembly 4 mounted in tandem. An exemplary embodiment of an illustrative forward motor assembly is provided in FIGS. 5A and 5B, while an exemplary embodiment of an illustrative forward motor assembly is provided in FIGS. 6A and 6B.

Within the guided projectile 6, the actuator system 10 is mounted axially along the central axis of the projectile 6. Actuator system 10 is secured by a plurality of rear motor mounts 20*a*, 20*b*, and a plurality of forward motor mounts 22*a*, to body 12 (not illustrated). It should be appreciated that actuator system 10 may employ any suitable number of motor mounts 20*a*, 20*b* and 22*a*, as needed to secure the actuator system 10 for its intended use within the body 12 of projectile 6. As shown in FIG. 1A, motor mount 22*a* protrudes through a window 24 in a cyclindrical gear member 26 to attach to body 12 (not illustrated).

Gear member 26 serves an extension of the ring gear 35 of the rear motor assembly 14. Gear member 26 is supported by thin section bearings 34 and 36, and includes face or sector gears that extend into a meshing or mating relationship with the pinion gears 27*a*, 27*b* of the output shafts 16*a* and 16*b*. In this embodiment, the output shafts 16*a*, 16*b* and 18*a*, 18*b* are disposed in the same transverse plane, normal to the longitudinal axis of the projectile 6, and spaced 90° apart about the circumference of the actuator system 10 for attachment through the body 12 to corresponding external steering fins 11. It should be appreciated that shafts 16*a* and 16*b* would be coupled to a first pair of opposing steering fins, and shafts 18*a* and 18*b* would be coupled to a second pair of opposing steering fins. Gear member 26 includes at least two face or sector gears. One face gear is located forward of a first opposing output shaft, and another face gear is located aft of the second opposing output shaft. This configuration allows rear motor assembly 4 to drive shafts 16*a* and 16*b* in the same rotational direction, thus achieving the effect of a single shaft between two opposite external fins. Likewise, gear member 60 allows forward motor assembly 3 to drive shafts 18*a* and 18*b* in the same rotational direction.

In this embodiment, gear member 26 of the rear motor assembly 4 reaches around the forward motor mounts 22*a* to apply torque to output shafts 16*a* and 16*b*. Thus, forward motor assembly 3 is at least partially telescopically received within a cavity formed by gear member 26, and the gear member 60 of forward motor assembly 3 extends rearward (over a portion of forward motor assembly 3) to apply torque to output shafts 18*a* and 18*b*. This tandem, axial mounting arrangement provides an extremely compact and lightweight actuator system.

Figure 7:
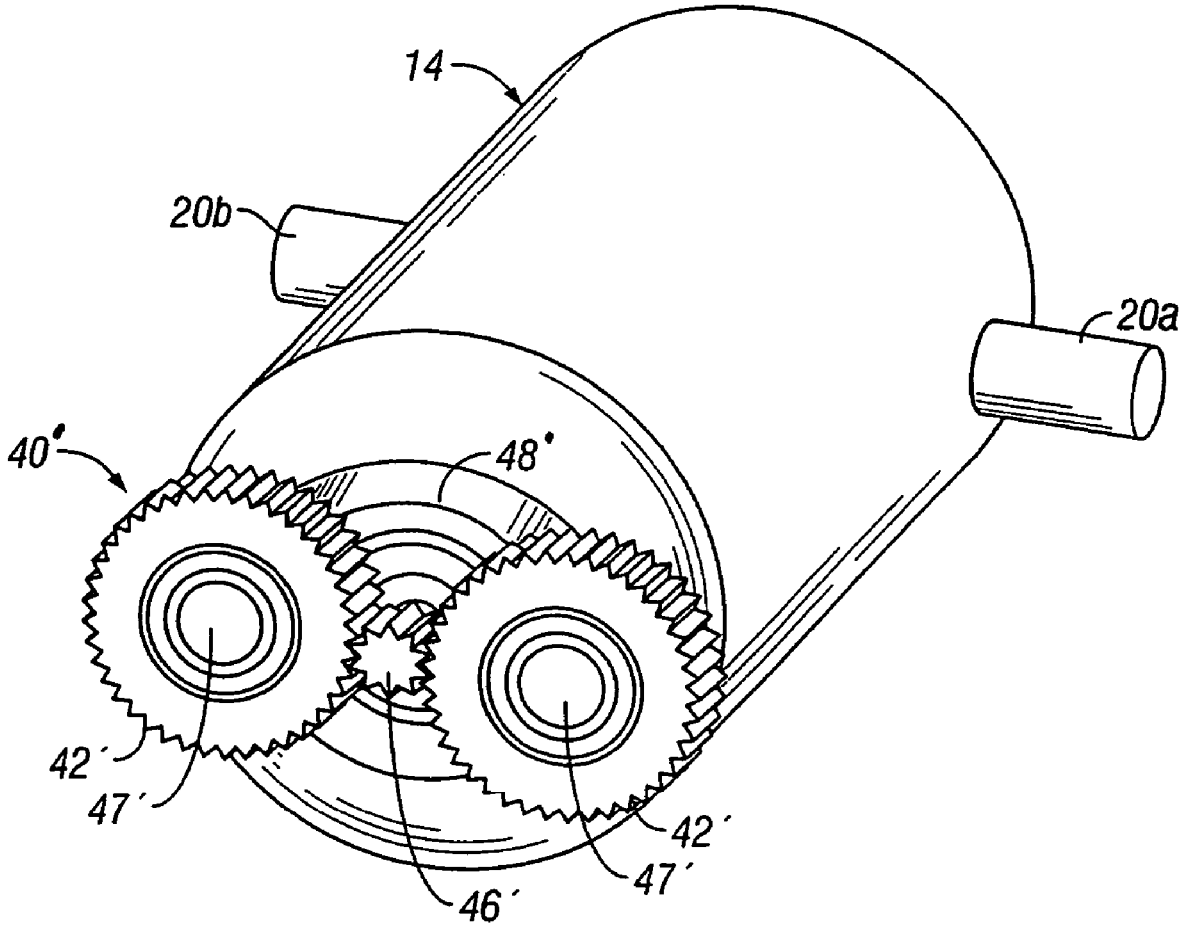
FIG. 7 is a perspective view of an illustrator motor in accordance with an embodiment of the invention.

At the forward end of the forward motor assembly 3 is a planetary gear train 40. Planetary gear train 40 includes a plurality of planetary gears 42, a ring gear 44 and a central sun gear 46. The sun gear 46 is rigidly attached to the body 12 of the projectile 6 (not illustrated). In this embodiment, two planetary gears 42 are rotatable on a pair of pins 47 extending from a carrier 48 (FIG. 4) which is driven by the forward motor 13. The rear motor assembly 4 has a planetary gear train 40' (as shown in FIG. 7) that functions in the same manner as planetary gear train 40 of the forward motor assembly 3. The sun gear 46' of the rear motor assembly 4 is rigidly affixed to an end plate 50 at the back end of the forward motor 13.

Gear member 26 is attached at the back end to a ring gear (that functions in the same manner as ring gear 44) and extends to the rotatable portion of the thin section bearing 34. Reference numerals 30, 32, 34 an 36 designate four section bearings, which in this embodiment, are rigidly attached to the body 12 of the projectile 6 (not illustrated).

At the forward end of gear member 26, projecting into the shaft gear space between the section bearings 32 and 34 is a face gear 52. Face gear 52 meshes or mates with the pinion gear 27*a* of shaft 16*a*, causing it to rotate as the ring gear of the rear motor assembly 4 rotates.

Extending rearwardly from the ring gear 44 of the forward planetary gear train 40 is another gear member 60 coupled to the ring gear 44 and extending rearward through the section bearing 32. Face gear 62 is located on the rearward end of the gear member 60 for meshing or mating with the pinion gear 28*a* of the shaft 18*a*. Face gears 52 and 62 are sector gears for mating with the pinion gears of associated output shafts. For purposes of illustration, gear teeth on these gears have been omitted for simplification.

Figure 5A:
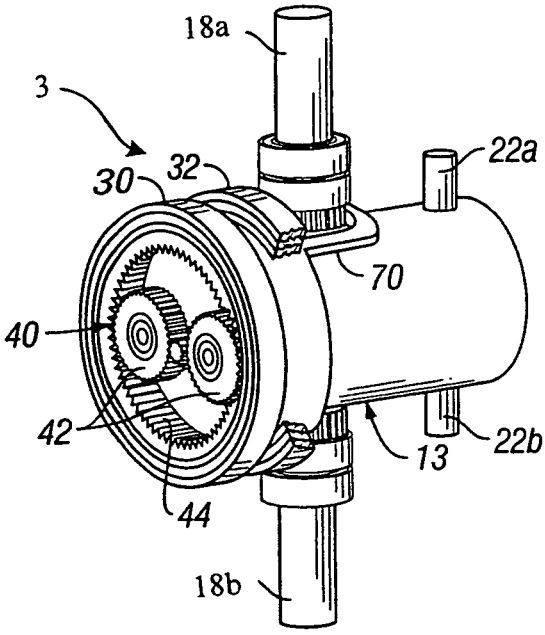
FIG. 5A is a partial sectional, perspective view of an illustrative first motor assembly of the actuator system in accordance with an embodiment of the invention.
Figure 5B:
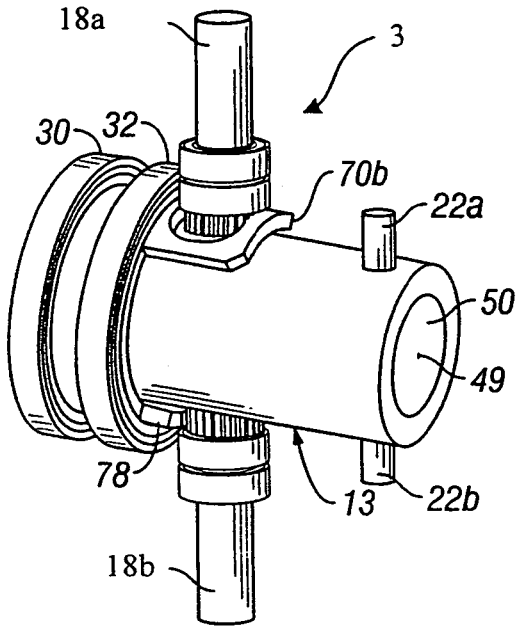
FIG. 5B is a rear perspective view of the first motor assembly of FIG. 5A in accordance with an embodiment of the invention.
Figure 5C:
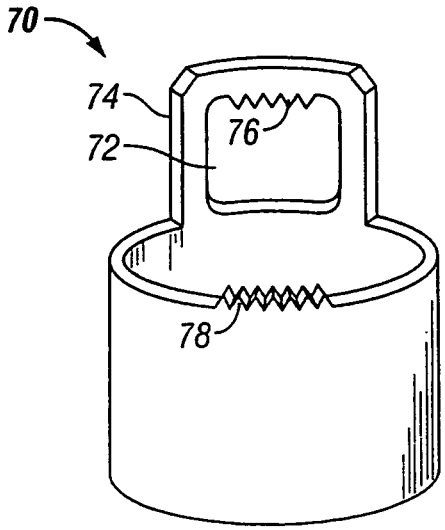
FIG. 5C is a perspective view of an illustrative gear member of the first motor assembly of FIGS. 5A and 5B in accordance with an embodiment of the invention.
Figure 6A:
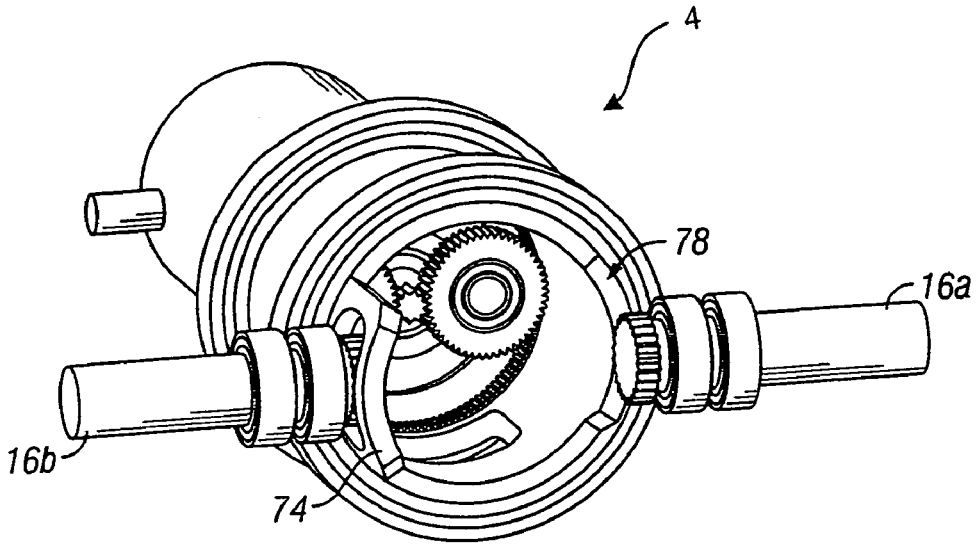
FIG. 6A is a perspective view of an illustrative second motor assembly in accordance with an embodiment of the invention.
Figure 6B:
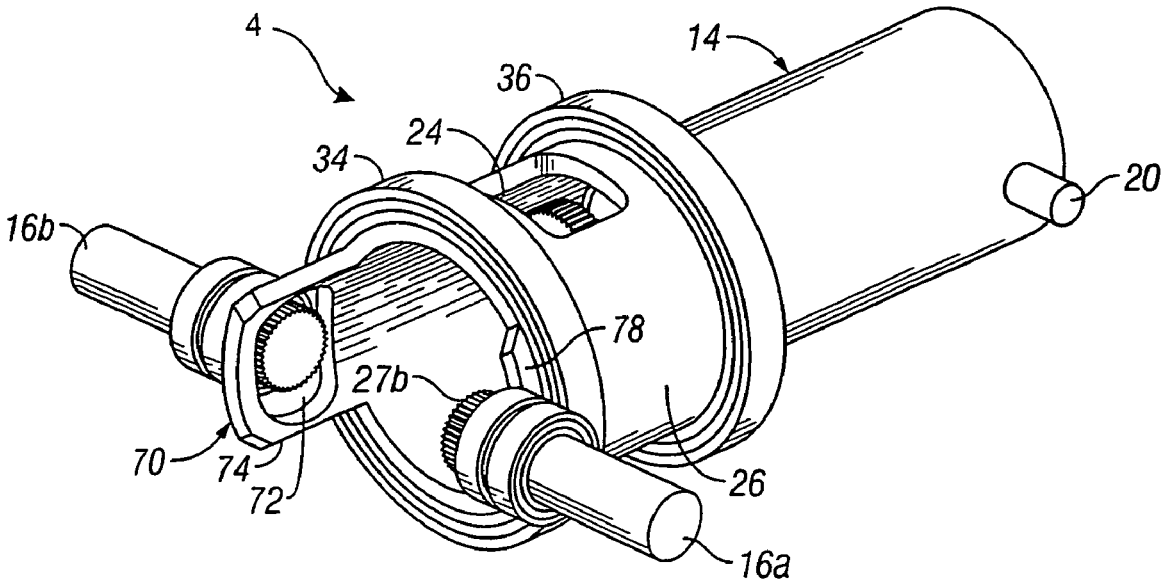
FIG. 6B is a perspective view of the second motor assembly of FIG. 6A in accordance with an embodiment of the invention.

FIGS. 5A and 5B are perspective views of an illustrative forward motor assembly in accordance with one embodiment of the invention, including associated ring gear and section bearing components. The upper shaft 16*a* extends through the small window 72 (as shown in further detail in FIG. 5C) in cyclindrical gear member 70. The upper edge of the window 72 comprises a face gear 76 comprised of a plurality of gear teeth for meshing or mating with the pinion gear 27*a* of shaft 16*a*. The opposite side of the cylinder 70 is provided with another face gear 78 having a plurality of gear teeth along its upper edge to engage pinion gear of the shaft 16*b*. A similar arrangement is illustrated in FIGS. 6A and 6B, which provide an exemplary embodiment of an illustrative rearward motor assembly similar to that described above with reference to rearward motor assembly 4.

FIG. 7 is a perspective view of an illustrator rear motor in accordance with an embodiment of the invention. FIG. 7 depicts the rearward motor 14 with the planet and sun gears of the planetary gear train 40' (an associated ring gear is not illustrated). In this embodiment, two pins 47' are mounted on carrier 48' to hold the planet gears 42' as they are driven around the sun gear 46' by rearward motor 14. It should be appreciated that forward motor 13 may operate to control a planetary gear train in a manner similar to rearward motor 14.

It will be readily appreciated that the mechanical devices of the present invention that provide for the controlled movement of the various components of the projectile and/or actuator system, may be controlled by automated systems known in the art. For example, one or more preprogrammed or programmable control systems may be used to automatically calculate and implement the necessary movements of the invention components to accomplish any desired movement. Moreover, the calculations necessary to automate the movement of the invention components are readily calculated using geometric and dynamic principles and equations, and such calculations are within the ordinary skill in the art of machine design. Input for automated and manual movements may be received by any useful input device, such as joysticks, or keypads or the like. In the case of an automatically controlled device, one or more joysticks having multiple movement axes may be used as a compact controller.

Other variations will be apparent and practicable without undue experimentation, in light of the present disclosure and with practice of the invention. For example, various components of the projectile and/or actuator system may receive input from or send output to a processing device machine to accomplish the desired function of the invention, such as the calculated control of the first and second motor assemblies to control the steering fins. The projectile and/or actuator system, or components thereof, may also receive commands from a controller workstation or other controller device through a processing device, or other mechanical components electronically coupled to or in communication with a processing device.

As used herein, the term processing device is to be understood to include at least one processor that uses at least one memory. The memory stores a set of instructions. The instructions may be either permanently or temporarily stored in the memory or memories of the processing device. The processor executes the instructions that are stored in the memory or memories in order to process data. The set of instructions may include various instructions that perform a particular task or tasks, such as those tasks described above. Such a set of instructions for performing a particular task may be characterized as a program, software program, or simply software. As noted above, the processing device executes the instructions that are stored in the memory or memories to process data. This processing of data may be in response to commands by a user or users of the processing device, in response to previous processing, in response to a request by another processing device and/or any other input, for example. The processing device used to implement exemplary embodiments of the invention may also be a general purpose computer. However, the processing machine described above may also utilize any of a wide variety of other technologies including a special purpose computer, a computer system including a microcomputer, mini-computer or mainframe, a programmed microprocessor, a micro-controller, an integrated circuit, a logic circuit, a digital signal processor, a programmable logic device, or any other device or arrangement of devices that is capable of implementing exemplary embodiments of the invention.

While the foregoing description includes details and specificities, it is to be understood that these have been included for purposes of explanation only, and are not to be interpreted as limitations of the present invention. Modifications to the embodiments described above can be made without departing from the spirit and scope of the invention, which is intended to be encompassed by the following claims and their legal equivalents.

What is claimed is:

1. An actuator system for a projectile having a first and second pair of opposing steering fins disposed in a transverse plane of the projectile, the first pair of opposing steering fins including a first fin and second fin, the second pair of opposing steering fins including a third fin and a fourth fin, the actuator system comprising:

a first motor assembly configured to control the position of the first pair of opposing steering fins; and a second motor assembly configured to control the position of the second pair of opposing steering fins, wherein the first motor assembly and second motor assembly are mounted axially along an axis of the projectile such that a first portion of the first motor assembly is telescopically received within a second portion of the second motor assembly.

2. The actuator system of claim 1, wherein the first motor assembly is adapted to apply torque to a first output shaft coupled to the first fin and a second output shaft coupled to the second fin such that the first output shaft and the second output shaft rotate in a first rotational direction.

3. The actuator system of claim 2, wherein the first output shaft includes a first pinion gear, and the second output shaft includes a second pinion gear.

4. The actuator system of claim 3, wherein the first motor assembly comprises a first planetary gear system including a first gear member having a first face gear for mating engagement with the first pinion gear and a second face gear for mating engagement with the second pinion gear.

5. The actuator system of claim 4, wherein the first face gear is disposed forward of the first pinion gear, and the second face gear is disposed aft of the second pinion gear.

6. The actuator system of claim 4, wherein the first planetary gear system further includes:

a first ring gear coupled to the first gear member;

a first plurality of planetary gears for mating engagement with the first ring gear; and a first motor adapted to drive the first plurality of planetary gears and cause the rotation of the first gear member.

7. The actuator system of claim 6, wherein the first planetary gear system further includes a first central sun gear fixed to a housing of the projectile, the first plurality of planetary gears being adapted to revolve about the first central sun gear in mating engagement.

8. The actuator system of claim 2, wherein the second motor assembly is adapted to apply torque to a third output shaft coupled to the third fin and a fourth output shaft coupled to the fourth fin such that the third output shaft and the fourth output shaft rotate in a second rotational direction.

9. The actuator system of claim 8, wherein the second motor assembly comprises a second planetary gear system including a second gear member having a third face gear for mating engagement with a third pinion gear of the third output shaft and a fourth face gear for mating engagement with a fourth pinion gear of the fourth output shaft.

10. The actuator system of claim 9, wherein the third face gear is disposed forward of the third pinion gear, and the fourth face gear is disposed aft of the fourth pinion gear.

11. The actuator system of claim 10, wherein the second planetary gear system further includes:

a second ring gear coupled to the second gear member;

a second plurality of planetary gears for mating engagement with the second ring gear; and a second motor adapted to drive the second plurality of planetary gears and cause the rotation of the second gear member.

12. The actuator system of claim 11, wherein the second planetary gear system further includes a second central sun gear fixed to the first motor assembly, the second plurality of planetary gears being adapted to revolve about the second central sun gear in mating engagement.

13. The actuator system of claim 9, wherein the second portion of the second motor assembly comprises the second gear member.

14. The actuator system of claim 9, wherein the second gear member further includes a plurality of windows through which a plurality of motor mounts attach to a housing of the projectile.

15. In a projectile having a plurality of steering fins disposed in a first transverse plane of the projectile, the plurality of steering fins including a first fin opposing a second fin, and a third fin opposing a fourth fin, an actuator system for controlling the positioning of the plurality of steering fins comprising:

a first forward motor assembly adapted to apply torque to a first output shaft coupled to the first fin and a second output shaft coupled to the second fin such that the first output shaft and the second output shaft rotate in a first rotational direction;

a second rearward motor assembly adapted to apply torque to a third output shaft coupled to the third fin and a fourth output shaft coupled to the fourth fin such that the third output shaft and the fourth output shaft rotate in a second rotational direction, wherein the first motor assembly and second motor assembly are mounted axially along an axis of the projectile such that a first portion of the first motor assembly is telescopically received within a second portion of the second motor assembly.

16. The actuator system of claim 15, wherein:

the first motor assembly comprises a first planetary gear system including a first gear member having a first face gear for mating engagement with a first pinion gear of the first output shaft and a second face gear for mating engagement with a second pinion gear of the second output shaft, and the second motor assembly comprises a second planetary gear system including a second gear member having a third face gear for mating engagement with a third pinion gear of the third output shaft and a fourth face gear for mating engagement with a fourth pinion gear of the fourth output shaft.

17. The actuator system of claim 16, wherein:

the first face gear is disposed forward of the first pinion gear, and the second face gear is disposed aft of the second pinion gear, and the third face gear is disposed forward of the third pinion gear, and the fourth face gear is disposed aft of the fourth pinion gear.

18. The actuator system of claim 16, wherein:

the first planetary gear system further includes a first ring gear coupled to the first gear member;

a first plurality of planetary gears for mating engagement with the first ring gear; and a first motor adapted to drive the first plurality of planetary gears and cause the rotation of the first gear member; and the second planetary gear system further includes a second ring gear coupled to the second gear member;

a second plurality of planetary gears for mating engagement with the second ring gear; and a second motor adapted to drive the second plurality of planetary gears and cause the rotation of the second gear member.

19. The actuator system of claim 18, wherein the first motor is at least partially disposed within the second gear member.

20. The actuator system of claim 18, wherein the second gear member further includes a plurality of windows through which a plurality of motor mounts attach the first motor to a housing of the projectile.

* * * * *